US006644110B1

(12) United States Patent
Curtis et al.

(10) Patent No.: US 6,644,110 B1
(45) Date of Patent: Nov. 11, 2003

(54) MEASUREMENTS OF PROPERTIES AND TRANSMISSION OF MEASUREMENTS IN SUBTERRANEAN WELLS

(75) Inventors: Fredrick D. Curtis, Stafford, TX (US); Paul Spriggs, Houston, TX (US); Vimal V. Shah, Sugar Land, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/244,337

(22) Filed: Sep. 16, 2002

(51) Int. Cl.[7] ..... E21B 47/06; E21B 47/01; G01V 1/00

(52) U.S. Cl. ..... 73/152.51; 73/152.22; 166/332.5; 175/48

(58) Field of Search ..... 73/152.51, 152.46, 73/152.38, 152.22; 166/332.5, 386; 340/854.8; 175/40, 48

(56) References Cited

U.S. PATENT DOCUMENTS

| | | | | | |
|---|---|---|---|---|---|
| 2,964,942 | A | * | 12/1960 | Reed | 73/152.51 |
| 3,283,570 | A | * | 11/1966 | Hodges | 73/152.51 |
| 3,577,783 | A | * | 5/1971 | Whitten et al. | 73/152.55 |
| 4,316,386 | A | * | 2/1982 | Kerekes | 73/152.51 |
| 4,408,486 | A | * | 10/1983 | Rochon et al. | 73/152.51 |
| 4,805,449 | A | * | 2/1989 | Das | 73/152.51 |
| 4,887,672 | A | * | 12/1989 | Hynes | 166/344 |
| 5,008,664 | A | | 4/1991 | More et al. | 340/854 |
| 5,202,681 | A | * | 4/1993 | Dublin, Jr. et al. | 340/856.4 |
| 5,531,270 | A | | 7/1996 | Fletcher et al. | 166/53 |
| 5,706,896 | A | | 1/1998 | Tubel et al. | 166/313 |
| 5,864,057 | A | * | 1/1999 | Baird | 73/152.38 |
| 5,971,072 | A | | 10/1999 | Huber et al. | 166/297 |
| 6,152,232 | A | | 11/2000 | Webb et al. | 166/373 |
| 6,343,649 | B1 | | 2/2002 | Beck et al. | |

OTHER PUBLICATIONS

Internet Web Page, "Design Considerstions for Diaphragm Pressure Transducers", dated 2001.
Internet Web Page, "Biaxial ("TEE") Rosette Pattern", dated 2001.
Internet Web Page, "Three–Element Rosette Pattern", dated 2001.
Internet Web Page, "Shear Strain Pattern", dated 2001.

* cited by examiner

*Primary Examiner*—Hezron Williams
*Assistant Examiner*—David J. Wiggins
(74) *Attorney, Agent, or Firm*—Marlin R. Smith

(57) ABSTRACT

A system of measuring properties, such as pressure, and transmitting measurements in a subterranean well. In a described example, a valve system includes a valve having a closure member. A sensor senses a pressure differential across the closure member. A tool positioned in the valve transmits power to the valve to operate the sensor, and the sensed pressure differential is transmitted from the valve to the tool.

43 Claims, 4 Drawing Sheets

MEASUREMENTS OF PROPERTIES AND TRANSMISSION OF MEASUREMENTS IN SUBTERRANEAN WELLS

BACKGROUND

The present invention relates generally to operations performed and equipment utilized in conjunction with subterranean wells and, in an embodiment described herein, more particularly provides a system of measuring properties and transmitting measurements in wells.

It is very beneficial to be able to measure properties, such as pressure, in a well and then transmit those measurements to a remote location, such as the earth's surface or another location in the well. For example, a valve system described in U.S. Pat. No. 6,152,232, the entire disclosure of which is incorporated herein by this reference, permits a drill string to be conveyed through a casing string in an underbalanced condition. The system includes a valve which is opened when the drill string is run into the casing string, and the valve is closed when the drill string is retrieved from the casing string.

In order to open the valve, it is desirable for there to be no pressure differential across a flapper of the valve, or at least for the pressure differential to be known before opening the valve. Unfortunately, however, there presently exists no satisfactory means for measuring this pressure differential at the time the drill string is run into the casing string, or for transmitting the pressure differential measurements to a remote location. Therefore, an operator must estimate the pressure differential by making certain assumptions, calculating hydrostatic pressure at the valve, etc., which leads to errors in the pressure differential estimate.

SUMMARY

In carrying out the principles of the present invention, in accordance with an embodiment thereof, a system and method are provided which solve the above problems in the art, and which are useful in other situations, as well. In an example described below, at least one sensor is used to sense a pressure differential across a closure member of a valve. An indication of the pressure differential is transmitted from the valve to a tool positioned in a flow passage of the valve for transmission to a remote location.

In one aspect of the invention, a method of measuring a pressure differential across a closure member of a valve in a well is provided. The method includes the steps of: positioning the valve in the well, a flow passage extending longitudinally through the valve, and the closure member blocking flow through the flow passage; sensing the pressure differential in the flow passage across the closure member using at least one sensor positioned in the valve; conveying a tool into the flow passage; and transmitting an indication of the sensed pressure differential from the valve to the tool.

In another aspect of the invention, a valve for use in a well is provided. The valve includes: a flow passage formed through the valve; a closure member operative to selectively permit and prevent flow through the flow passage; and at least one sensor operative to sense a pressure differential in the flow passage across the closure member.

In yet another aspect of the invention, a valve system for use in a well is provided. The valve system includes: a valve positioned in the well, the valve including a closure member selectively permitting and preventing flow through a flow passage formed through the valve, and at least one sensor operative to sense a pressure differential in the flow passage across the closure member; and a tool positioned in the flow passage, the tool transmitting power to the valve to operate the sensor, and the valve transmitting an indication of the sensed pressure differential to the tool.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
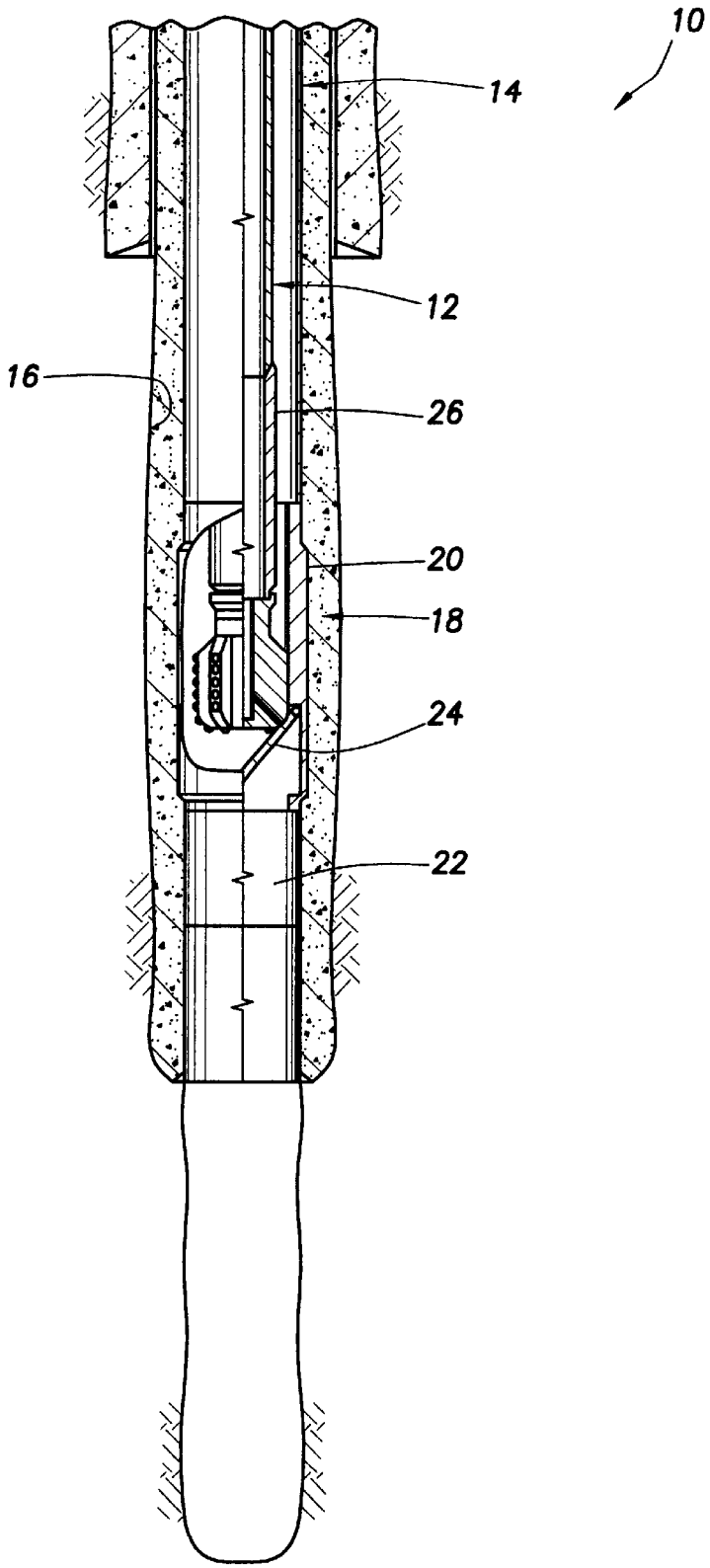
FIG. 1 is a schematic partially cross-sectional view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10, a drill string 12 is conveyed through a casing or liner string 14 in a wellbore 16. A valve system 18 is used to open a valve 20 interconnected in the casing string 14 to permit the drill string 12 to pass though the valve, and to close off a flow passage 22 extending longitudinally through the valve and casing string when the drill string is retrieved from the well.

As used herein, the term "casing string" is used to indicate any type of tubular string which lines a wellbore, such as casing and liner strings. As used herein, the term "drill string" is used to indicate any type of tubular string which is conveyed through a casing or liner string, for example, to drill a wellbore, to produce fluids from a wellbore, inject fluids into a wellbore, etc.

It is to be understood that the method lo, which includes the valve system 18 used to facilitate passage of the drill string 12 through the casing string 14, is described herein as merely an example of one application of the principles of the invention. The method 10 illustrates application of the invention to the situation wherein a well is drilled underbalanced. But the principles of the invention may also be applied to other situations, such as well control in overbalanced drilling operations to prevent loss of circulation, underbalanced operations wherein slotted liners or sand screens are to be installed without killing the well, deep water applications wherein equivalent circulating density is reduced to control "ballooning", etc. Therefore, the invention is not limited by the specific details of the method 10 described herein.

The valve 20 includes a closure member or "flapper" 24 which pivots in the flow passage 22 to selectively permit or prevent flow through the passage. Thus, a pressure differential may exist in the passage 22 across the member 24 when it is closed. Preferably, the pressure differential does not exist across the member 24 when the drill string 12 is displaced through the valve 20 and opens the valve.

The valve system 18 also includes a telemetry tool 26 interconnected in the drill string 12. The telemetry tool 26 communicates with at least one sensor (not visible in FIG. 1) in the valve 20, which provides an indication of the pressure differential across the member 24. This pressure differential indication is transmitted by the telemetry tool 26 to a remote location, such as the earth's surface, so that appropriate actions may be taken to relieve any excessive pressure differential across the member 24 before attempting to open the valve 20.

To eliminate the need of installing a power source, such as batteries, in the valve 20 to provide power to operate the sensor(s) in the valve, the tool 26 preferably also supplies power to the valve. Power may be transmitted from the tool 26 to the valve 20 via inductive coupling. Inductive coupling may also be used to transmit the pressure differential indications from the valve 20 to the tool 26.

When the pressure differential across the member 24 is relieved, or at least reduced to an acceptable level, the passage 22 is opened, permitting the drill string 12 to pass through the passage past the member 24. When the drill string 12 is retrieved upwardly through the casing string 14, the member 24 again closes, preventing flow through the passage 22 and again permitting a pressure differential to exist across the member.

Other than the power and communication transmitting between the valve 20 and the tool 26 described above, the tool may be similar to conventional near-bit telemetry tools used in drilling operations, such as the At-Bit-Inc telemetry system available from Sperry-Sun Drilling Services, Inc. Such systems may use acoustic (ABI) "short hop" telemetry across a mud motor in the drill string 12, and mud pulse "long hop" telemetry to communicate with a remote location, such as the earth's surface. In certain applications it may be desirable to eliminate the short hop telemetry and communicate directly with the remote location using only long hop telemetry. However, it should be understood that any and all types of telemetry, including currently available and later developed telemetry systems, may be used in keeping with the principles of the invention.

Note that the power and communication transmitting between the valve 20 and the tool 26 may be by means other than inductive coupling, in keeping with the principles of the invention. Any power transmitting systems and any communication transmitting systems, whether currently available or later developed, may be used in the method 10.

Figure 2:
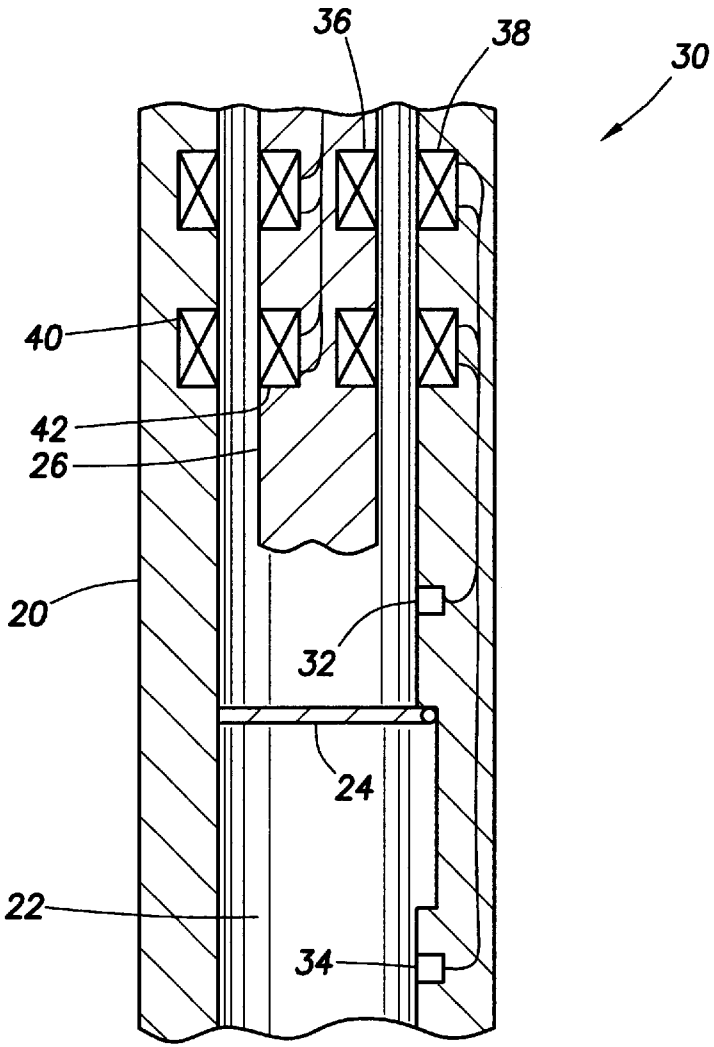
FIG. 2 is an enlarged scale schematic cross-sectional view through a valve system used in the method of FIG. 1.

Referring additionally now to FIG. 2, a valve system 30 which may be used for the valve system 18 in the method 10 is representatively illustrated. In the system 30, the valve 20 includes two sensors 32, 34. The sensors 32, 34 may be simple strain gauges which detect strain in the valve 20 above and below the member 24, respectively, or they may be more complex sensors, such as pressure transducers, etc. The sensors 32, 34 provide indications of pressure in the passage 22 on respective opposite sides of the member 24, so that a pressure differential across the member is sensed.

Power to operate the sensors 32, 34 is supplied from the tool 26 to the valve 20 when the tool is positioned within the passage 22 in the valve. Specifically, a coil 36 of the tool 26 is positioned laterally opposite a coil 38 of the valve 20. Inductive coupling between the coils 36, 38 transmits power from the tool 26 to the valve 20 in a manner well known to those skilled in the art.

The coil 38 is connected to the sensors 32, 34 to operate the sensors. The sensors 32, 34 sense pressure on opposite sides of the member 24 when the sensors are supplied with power from the coil 38.

The sensors 32, 34 are connected to another coil 40 of the valve 20, which is inductively coupled with another coil 42 of the tool. Indications of a pressure differential across the member 24 are transmitted from the coil 40 to the coil 42. For example, the pressure indications could be in analog form (such as Wheatstone bridge potential in the case of strain gauge-type sensors), or in digital form (such as digital signals typically produced by pressure transducers).

Thus, it will be appreciated that the valve system 30 permits the pressure differential across the member 24 to be transmitted to a remote location prior to opening the valve 20. Preferably, the member 24 is not displaced to open the passage 22 and permit passage of the tool 26 (or any other portion of the drill string 12) past the member, unless the pressure differential is below a minimum level.

Figure 3:
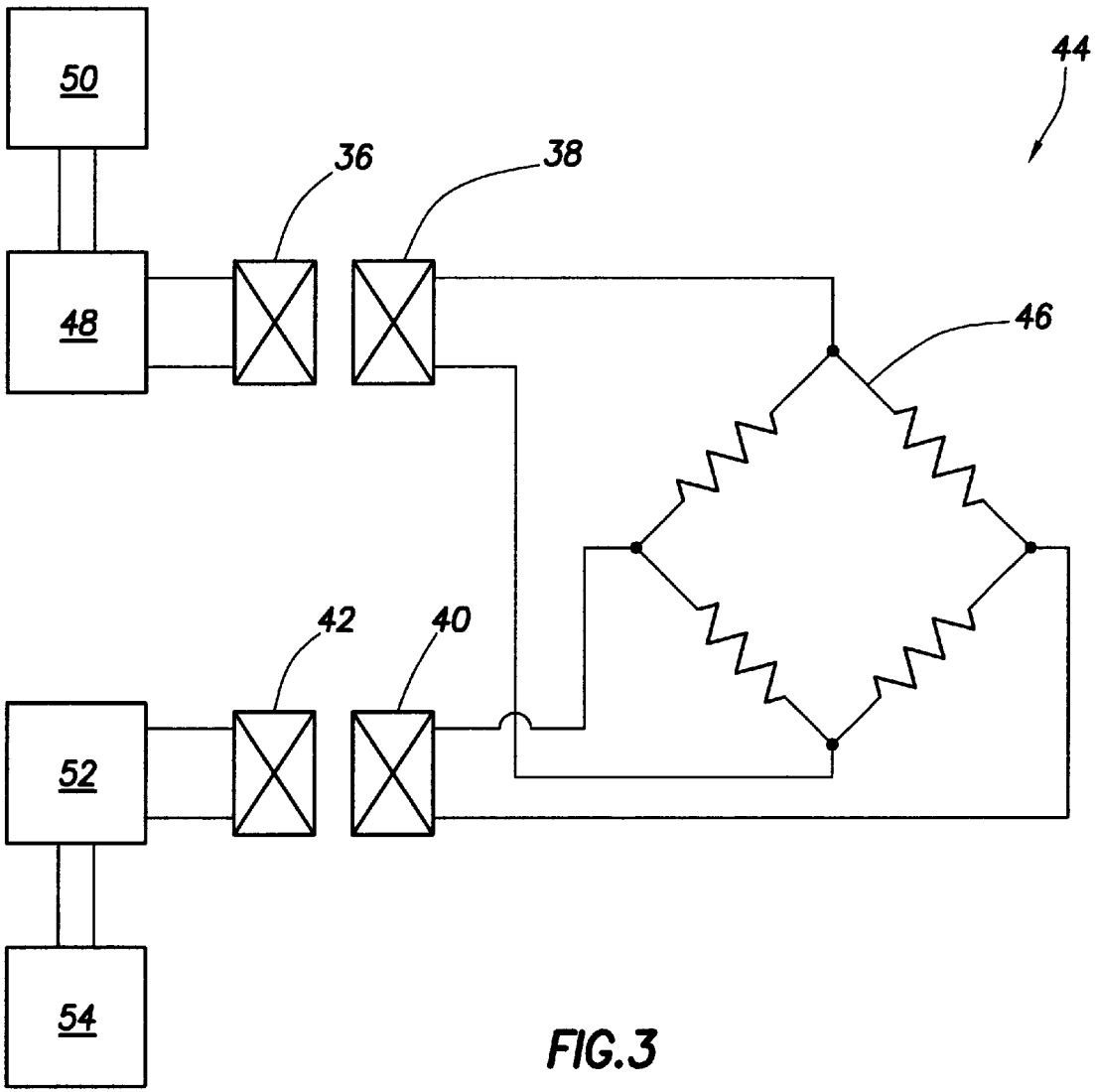
FIG. 3 is a schematic circuit block diagram used in the method of FIG. 1.

Referring additionally now to FIG. 3, an example of a circuit block diagram 44 which may be used in the valve system 30 is representatively illustrated. A Wheatstone bridge 46 is depicted in the diagram 44 to represent the sensors 32, 34, but it is to be understood that any source of pressure indications may be used in keeping with the principles of the invention.

An oscillator 48 is used to drive the power transmission coil 36 in the tool 26. The oscillator 48 is supplied with electrical power by a power supply 50. The power supply 50 could be, for example, batteries or a mud turbine, etc.

The output of the communication coil 42 in the tool 26 is connected to an amplifier/demodulator 52. The output of the amplifier/demodulator 52 is connected to a telemetry system 54 of the tool 26. The telemetry system 54 is conventional and may be, for example, acoustic or mud pulse telemetry as described above, or any other type of telemetry, such as electromagnetic, etc.

Figure 4:
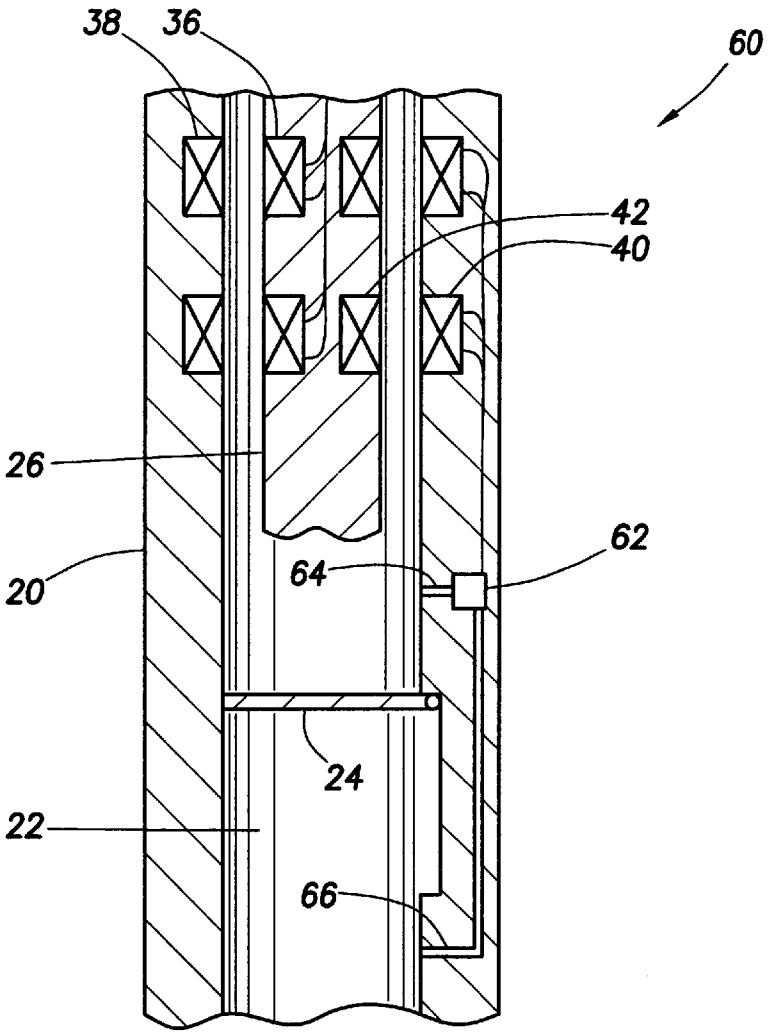
FIG. 4 is a schematic cross-sectional view through a first alternative valve system.

Referring additionally now to FIG. 4, another valve system 6o which may be used for the valve system 18 in the method 10 is representatively illustrated. Instead of separate sensors 32, 34 exposed to pressure on respective opposite sides of the member 24 as in the system 30 described above, the valve system 60 uses a single sensor 62 to sense the pressure differential across the member.

The sensor 62 is exposed to pressure above the member 24 via a passage 64. The sensor 62 is exposed to pressure below the member 24 via another passage 66. One benefit of using the sensor 62 is that only a single sensor is required to sense the pressure differential across the member 24. The sensor 62 may be, for example, a pressure differential transducer.

The sensor 62 is connected to the coils 38, 40 of the valve 20. Power to operate the sensor 62 is transmitted from the tool 26 to the valve 20 via inductive coupling between the coils 36, 38. Indications of the pressure differential across the member 24 are transmitted from the valve 20 to the tool 26 via inductive coupling between the coils 40, 42.

Figure 5:
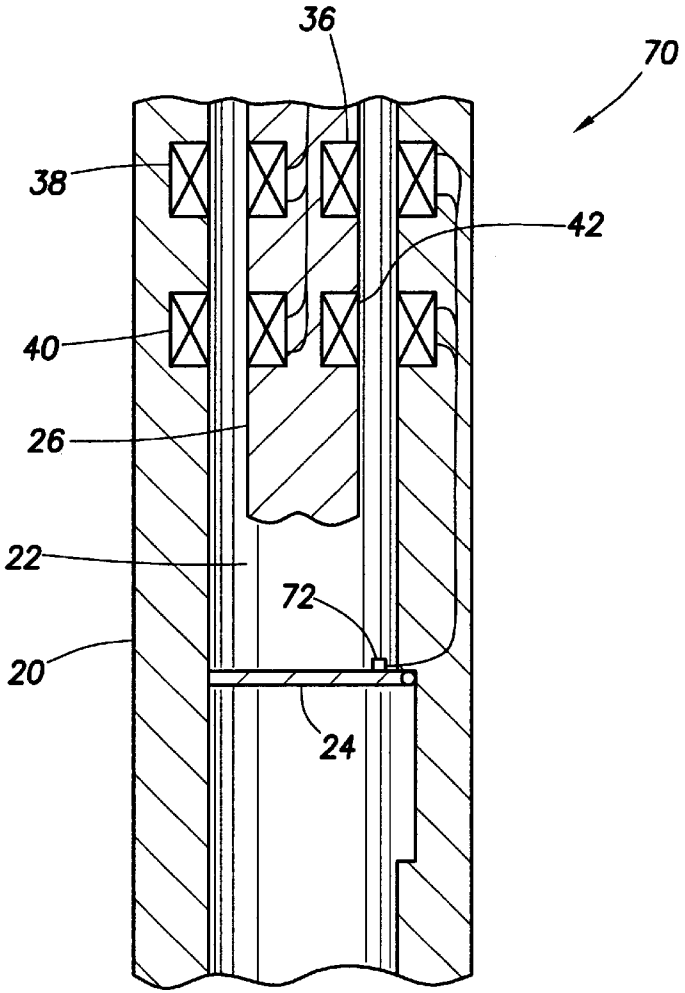
FIG. 5 is a schematic cross-sectional view through a second alternative valve system.

Referring additionally now to FIG. 5, another valve system 70 which may be used for the valve system 18 in the method 10 is representatively illustrated. Instead of separate sensors 32, 34, or a single sensor 62, exposed to pressure on opposite sides of the member 24 as in the systems 30, 60 described above, the valve system 70 uses at least one sensor 72 to sense strain in the member.

Strain in the member 24 due to a pressure differential will be sensed by the sensor 72 as an indication of the pressure differential. The sensor 72 may be, for example, a strain gauge.

The sensor 72 is preferably attached to the member 24 on the same side of the member as the tool 26 is positioned in the passage 22. Thus, the sensor 72 is exposed to the same pressure in the passage 22 as the tool 26. One benefit of using this configuration is that fluid porting to below the member 24 and sealing of passages for fluid or wires extending to below the member 24 is not required. However, it should be understood that sensors may be attached to either or both of the opposite sides of the member 24, in keeping with the principles of the invention.

The sensor 72 is connected to the coils 38, 40 of the valve 20. Power to operate the sensor 72 is transmitted from the tool 26 to the valve 20 via inductive coupling between the coils 36, 38. Indications of the pressure differential across the member 24 are transmitted from the valve 20 to the tool 26 via inductive coupling between the coils 40, 42.

Figure 6:
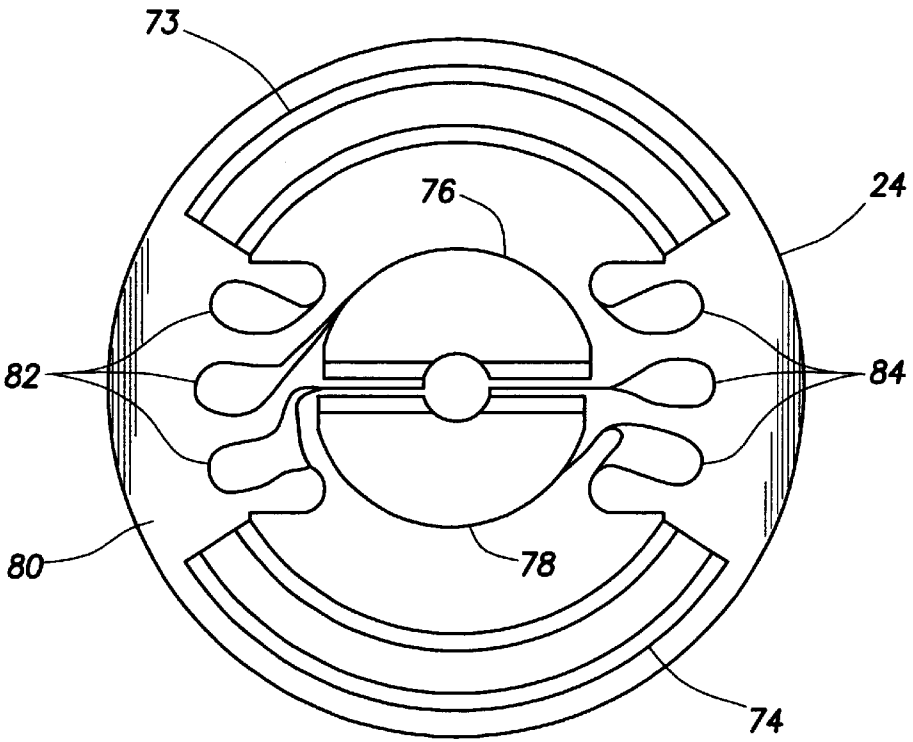
FIG. 6 is an enlarged scale schematic top view of a valve closure member of the valve system of FIG. 5.

Referring additionally now to FIG. 6, a top view of the member 24 is representatively illustrated. In this view of the member 24 is depicted a presently preferred arrangement of sensors 73, 74, 76, 78 attached to the member to sense strain therein. This arrangement of sensors 73, 74, 76, 78 may be used in the valve system 70 described above. The sensors 73, 74, 76, 78 are strain gauges attached directly to an upper surface area 80 of the member 24, which is exposed to the same pressure in the passage 22 as the tool 26 when the valve 20 is closed.

As shown in FIG. 6, the sensors 73, 74 are attached near a peripheral edge of the member 24. In contrast, the sensors 76, 78 are attached near a center of the member 24. The member 24 is similar in some respects to a membrane having strain induced therein due to a pressure differential across the membrane. This arrangement of the sensors 73, 74, 76, 78 will readily detect this membrane-type strain distribution.

Terminals or leads 82, 84 are used to supply electrical potential across the sensors 73, 74, 76, 78.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of measuring a pressure differential across a closure member of a valve in a subterranean well, the method comprising the steps of:

positioning the valve in the well, a flow passage extending longitudinally through the valve, and the closure member blocking flow through the flow passage;

sensing the pressure differential in the flow passage across the closure member using at least one sensor positioned in the valve;

conveying a tool into the flow passage; and transmitting an indication of the sensed pressure differential from the valve to the tool.

2. The method according to claim 1, wherein the positioning step further comprises interconnecting the valve in a tubular string, the flow passage extending through the tubular string.

3. The method according to claim 2, wherein in the positioning step, the tubular string is a casing string.

4. The method according to claim 2, wherein the conveying step further comprises interconnecting the tool in a drill string conveyed through the tubular string.

5. The method according to claim 1, wherein the conveying step further comprises exposing the tool to a pressure in the flow passage on one side of the closure member, and wherein the sensing step further comprises exposing the sensor to the same pressure.

6. The method according to claim 1, wherein in the sensing step, the at least one sensor is a single sensor sensing the pressure differential across the closure member.

7. The method according to claim 6, wherein in the sensing step, the sensor is a pressure differential transducer in communication with fluid pressure on opposite sides of the closure member.

8. The method according to claim 6, wherein in the sensing step, the sensor is a strain sensor which senses strain in the closure member due to the pressure differential.

9. The method according to claim 8, wherein in the sensing step, the strain sensor is attached directly to the closure member.

10. The method according to claim 8, wherein in the conveying step, the strain sensor and the tool are exposed to a same pressure in the flow passage.

11. The method according to claim 1, wherein in the sensing step, the at least one sensor includes multiple sensors sensing pressure on opposite sides of the closure member.

12. The method according to claim 1, further comprising the steps of:

opening the flow passage by operating the valve to displace the closure member; and then displacing the tool through the open flow passage past the closure member.

13. The method according to claim 12, further comprising the step of preventing the tool from displacing through the flow passage past the closure member until the opening step is performed.

14. The method according to claim 1, wherein the transmitting step further comprises coupling inductively between the tool and the valve.

15. The method according to claim 1, further comprising the step of supplying power to operate the sensor by transmitting power from the tool to the valve.

16. The method according to claim 15, wherein the power transmitting step further comprises coupling inductively between the tool and the valve.

17. A valve for use in a subterranean well, the valve comprising:

a flow passage formed through the valve;

a closure member operative to selectively permit and prevent flow through the flow passage; and at least one sensor operative to sense a pressure differential in the flow passage across the closure member.

18. The valve according to claim 17, wherein the at least one sensor senses strain in the closure member due to the pressure differential.

19. The valve according to claim 18, wherein the at least one sensor is attached directly to the closure member.

20. The valve according to claim 18, wherein the at least one sensor is a strain gauge.

21. The valve according to claim 18, wherein the at least one sensor includes multiple sensors distributed on a surface area of the closure member.

22. The valve according to claim 21, wherein a first one of the sensors is positioned centrally on the closure member, and a second one of the sensors is positioned peripherally on the closure member.

23. The valve according to claim 17, wherein the at least one sensor is a pressure differential transducer exposed to pressure in the flow passage on opposite sides of the closure member.

24. The valve according to claim 17, wherein the at least one sensor includes first and second sensors, each of the first and second sensors being exposed to pressure in the flow passage on a respective side of the closure member.

25. The valve according to claim 17, further comprising a first coil connected to the at least one sensor, the first coil being operative to supply power to operate the sensor via inductive coupling.

26. The valve according to claim 25, further comprising a second coil connected to the at least one sensor, the second coil being operative to transmit indications of sensed pressure from the sensor via inductive coupling.

27. The valve according to claim 17, further comprising a coil connected to the at least one sensor, the coil being operative to transmit indications of sensed pressure from the sensor via inductive coupling.

28. A valve system for use in a subterranean well, the valve system comprising:

a valve positioned in the well, the valve including a closure member selectively permitting and preventing flow through a flow passage formed through the valve, and at least one sensor operative to sense a pressure differential in the flow passage across the closure member; and a tool positioned in the flow passage, the valve transmitting an indication of the sensed pressure differential to the tool.

29. The valve system according to claim 28, wherein the tool transmits power to the valve to operate the at least one sensor.

30. The valve system according to claim 29, wherein the tool transmits power to the valve via inductive coupling.

31. The valve system according to claim 28, wherein the valve transmits the indication to the tool via inductive coupling.

32. The valve system according to claim 28, wherein the tool is permitted to displace through the flow passage past the closure member only when the closure member has been displaced to permit flow through the flow passage.

33. The valve system according to claim 28, wherein the at least one sensor senses strain in the closure member due to the pressure differential.

34. The valve system according to claim 28, wherein the at least one sensor is attached directly to the closure member.

35. The valve system according to claim 28, wherein the at least one sensor and the tool are exposed to a same pressure in the flow passage when the closure member prevents flow through the flow passage.

36. The valve system according to claim 28, wherein the at least one sensor and the tool are positioned on a same side of the closure member when the closure member prevents flow through the flow passage.

37. The valve system according to claim 28, wherein the at least one sensor includes a strain gauge sensing strain in the closure member.

38. The valve system according to claim 28, wherein the at least one sensor includes a pressure differential transducer exposed to pressure on opposite sides of the closure member.

39. The valve system according to claim 28, wherein the at least one sensor includes first and second sensors, each of the first and second sensors sensing pressure on a respective opposite side of the closure member.

40. The valve system according to claim 28, wherein the at least one sensor includes multiple sensors distributed on a surface area of the closure member.

41. The valve system according to claim 40, wherein at least a first one of the multiple sensors is positioned centrally on the closure member, and at least a second one of the multiple 'sensors is positioned peripherally on the closure member.

42. The valve system according to claim 28, wherein the valve is interconnected in a casing string, the flow passage extending longitudinally through the casing string, and wherein the tool is interconnected in a drill string conveyed into the casing string.

43. The valve system according to claim 42, wherein displacement of the drill string through the valve causes the closure member to displace, thereby selectively permitting and preventing flow through the flow passage.

* * * * *